United States Patent [19]

Konishi et al.

[11] Patent Number: 4,897,754

[45] Date of Patent: Jan. 30, 1990

[54] SWITCHING APPARATUS

[75] Inventors: Keisuke Konishi, Takatsuki; Norio Iwakiri, Kyoto; Hiroyuki Yamada; Masanori Ishii, both of Suita, all of Japan

[73] Assignee: Omron Tateisi Electronics Co., Kyoto, Japan

[21] Appl. No.: 357,275

[22] Filed: May 26, 1989

Related U.S. Application Data

[63] Continuation of Ser. No. 93,702, Sep. 8, 1987, abandoned.

[30] Foreign Application Priority Data

Sep. 12, 1986 [JP] Japan ..... 61-216543

[51] Int. Cl.[4] ..... H01H 35/00; H01H 3/16

[52] U.S. Cl. ..... 361/1; 361/94; 361/179; 200/18; 200/47; 307/116; 307/119; 307/113; 324/422; 324/423; 340/644

[58] Field of Search ..... 361/176, 177, 1, 94; 307/116, 119, 113, 132 EA; 340/644; 200/18, 47; 324/422, 423, 424

[56] References Cited

U.S. PATENT DOCUMENTS

| | | | |
|---|---|---|---|
| 3,059,071 | 10/1962 | Dobes | 200/47 |
| 4,247,744 | 1/1981 | Birkle | 200/47 |
| 4,670,812 | 6/1987 | Doerfler et al. | 361/94 X |

*Primary Examiner*—Todd E. Deboer

*Attorney, Agent, or Firm*—Stevens, Davis, Miller & Mosher

[57] ABSTRACT

There are provided a first switch which is switched to the on state or the off state in association with a displacement of an actuator which causes a displacement by a contact with an object and a second switch which is switched to the on state or off state later than the first switch in association with the displacement of the actuator. A switch output is produced and an abnormality is detected in accordance with the on and off states of these switches.

7 Claims, 12 Drawing Sheets

AC
SWITCH OUTPUT
FAILURE PREDICTION OUTPUT
POWER SUPPLY
SWITCH OUTPUT CIRCUIT
ABNORMALITY DETECTING LOGIC
FAILURE PREDICTING CIRCUIT
SWITCH STATE DETECTION
START
TIMER
RESET
OSC
CONTACT STATE DETECTION
CONTACT SENSOR
+Vcc
88
60
40
70
20
30
82
80
20A
17
11
12
a1
a2
b
s
p
g1
i1
g2
i2
g1(h1)
i1(j1)
g2(h2)
i2(j2)

SWITCHING APPARATUS

This application is a continuing application of Ser. No. 093,702, filed Sept. 8, 1987 now abandoned.

BACKGROUND OF THE INVENTION

The present invention relates to a switching apparatus having an actuator in which when an object comes into contact with the actuator, a switch output indicative of the detection of the object is generated in response to a displacement of the actuator.

Such a kind of switching apparatus is used to detect an object and control various kinds of machines or apparatuses. For example, in the production line in an unmanned factory, such a switching apparatus is used to detect when an object such as a product or the like to be worked has been transported to a predetermined position, so that a working machine is automatically actuated.

Hitherto, a limit switch has generally been used as such a kind of switching apparatus. A contact mechanism provided in the limit switch is switched between the on (conductive) state and the off (nonconductive) state in association with the displacement of the actuator which is caused by the contact with an object or in response to the actuator being returned to the original position by an urging means such as a return spring or the like.

In the switching apparatus with the foregoing constitution, a defective contact or the like occurs due to the following causes. Namely, a displacement of the actuator does not accurately occur or the actuator is not properly returned to the original position because of an increase in frictional force; water enters the switching apparatus due to a defective sealing, causing the internal circuits or contacts to be short-circuited; contacts are fused and bonded or bent or damaged; chips or dusts are interposed between contacts; and the like. Thus, a malfunction such that the object cannot be correctly detected occurs. When the object cannot be correctly detected, even if the object has been carried to a predetermined position, the machine or apparatus is not actuated, so that a defective machining of a product occurs or an unfinished product is erroneously taken out as a normal product. Hitherto, only when such an unexpected accident occurred, the defective operation of the limit switch is found out. Consequently, the production line must be stopped to repair the limit switch. There is a problem such that even if the production line is temporarily stopped as mentioned above, adverse influences are also exerted on the other producing processes and the producing efficiency deteriorates.

Therefore, in order to enable the limit switch to certainly perform the on/off operations, there is an apparatus having a mechanism to prevent a contact from becoming fused and bonded, a contact peeling-off mechanism to forcedly turn off the contact even if the contact was fused and bonded, or the like. However, this apparatus cannot cope with the case where the actuator is not properly returned because of an increase in frictional force when the apparatus is used, the case where chips, dusts or the like are interposed between contacts of the limit switch, so that the limit switch is not switched from the off state to the on state, or the like.

There is also a system in which a life time of the limit switch is stored in an external control unit including a computer and the life time is managed. In this system, the operating time of the production line is calculated and the cumulative operating time is compared with the life time stored, and when the cumulative operating time exceeds the life time, a failure prediction signal is output. However, there is a drawback such that the external control unit increases in size and becomes expensive. Moreover, since a failure cannot be accurately predicted in accordance with the actual situation, there are inconveniences such that an abnormality occurs before the failure prediction signal is output, and in spite of the fact that the apparatus is normally operating, a failure prediction signal is output, and the like.

SUMMARY OF THE INVENTION

It is an object of the present invention to enable a failure to be predicted in accordance with the actual operating state in a switching apparatus.

Another object of the present invention is to provide a switching apparatus which can continuously generate a proper switch output even if some kinds of abnormality of operation occur.

A switching apparatus according to the present invention comprises: an actuator which causes a displacement due to the contact with an object; first detecting means for detecting a first displacement position of the actuator; second detecting means for detecting a second displacement position of the actuator; means for generating a switch output on the basis of at least either one of the detection outputs of the first and second detecting means; and means for detecting an abnormality on the basis of at least either one of the detection outputs of the first and second detecting means.

According to the present invention, at least two displacement positions (including the original position or return position) of the actuator are detected and an abnormality is detected on the basis of these detection outputs, so that a failure can be predicted on the basis of the actual operating state. On the other hand, since a switch output is generated on the basis of the two displacement positions of the actuator, even if an abnormality occurred at one of the displacement positions, a proper switch output can be continuously generated.

BRIEF DESCRIPTION OF THE DRAWINGS

FIGS. 1 to 7 show an embodiment of the present invention;

FIG. 1 is a cross sectional view showing a constitution of a switching apparatus;

FIG. 2 is a cross sectional view taken along the line II—II in FIG. 1;

FIG. 3 is a block diagram showing an outline of a signal processor provided in the switching apparatus;

FIG. 8 shows a modification of the embodiment and illustrates a part of a block diagram corresponding to FIG. 3;

FIG. 9 shows a part of a cross sectional view corresponding to FIG. 1; and FIG. 10 is a block diagram showing a signal processor.

DETAILED DESCRIPTION OF THE PREFERRED EMBODIMENTS

Figure 1:
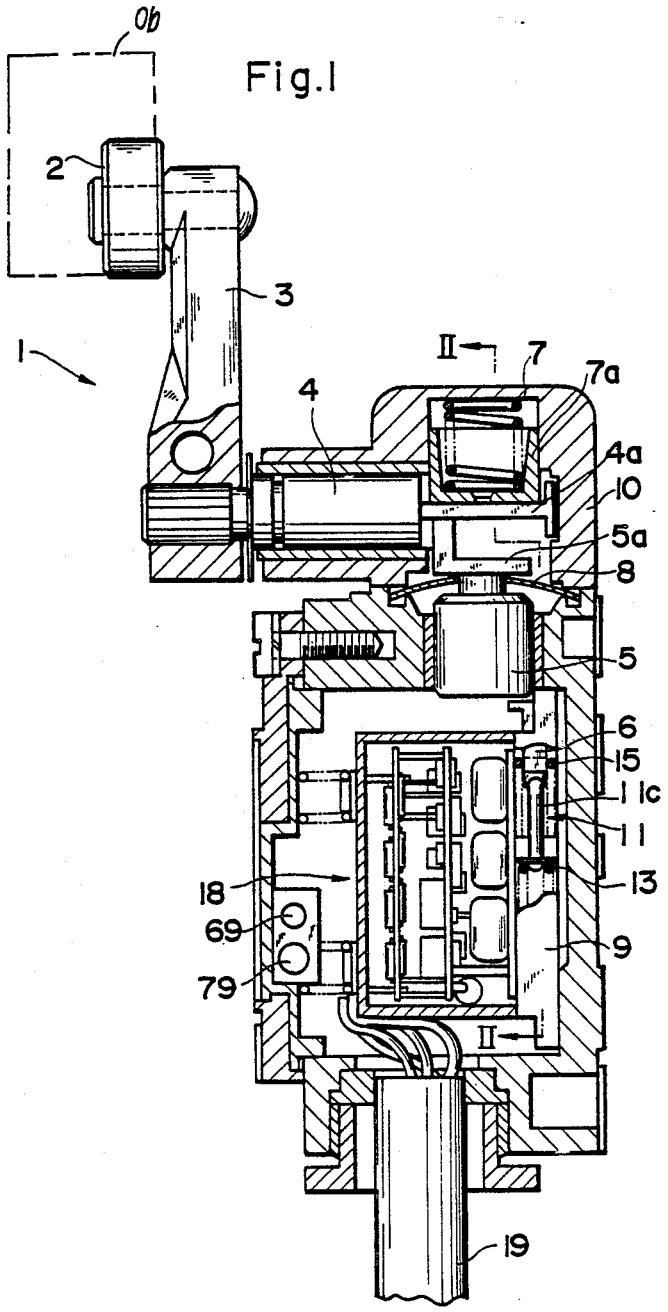
Figure 2:
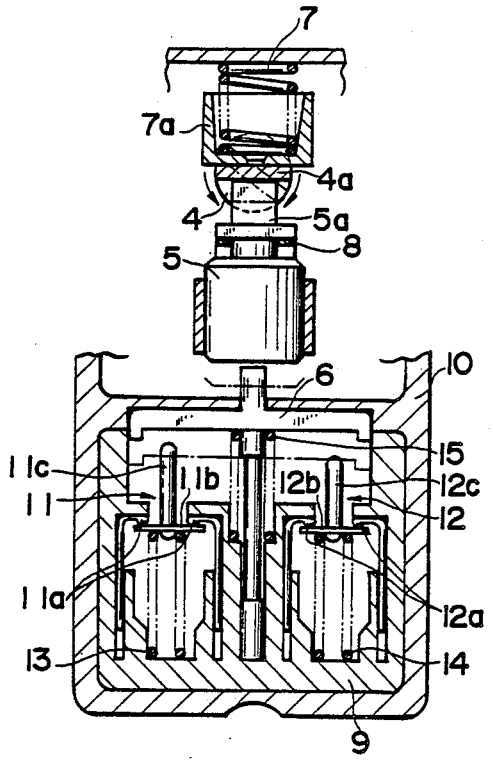

FIGS. 1 and 2 show a mechanical construction of an embodiment of the present invention.

Referring to these diagrams, an actuator 1 causes a displacement by a pressing force due to a contact with an object such as a product or the like which is transported in a production line. The actuator 1 comprises: a rotary shaft 4 rotatably attached to a casing 10; a lever 3 fixedly attached to the outer end portion of the rotary shaft 4; a roller 2 which is rotatably attached to the tip of the lever 3 and comes into contact with an object; and a plunger 5 to convert a rotational displacement of the rotary shaft 4 which is caused by the contact of the object with the roller 2 into a displacement in the rectilinear direction.

The inner edge surface of the rotary shaft 4 is formed with a plate portion 4*a* extending in its axial direction. The plate portion 4*a* functions to return the actuator 1 to the original position in cooperation with a return coil spring 7 and also functions to convert the rotational motion of the rotary shaft 4 into the rectilinear motion of the plunger 5 in cooperation with a propagating member 5*a* of the plunger 5.

The coil spring 7 is attached between one surface of the plate portion 4*a* and the casing 10. A cylindrical receiving member 7*a* is supported to the casing 10 so as to be slidable in the direction perpendicular to the axial direction of the rotary shaft 4. The receiving member 7*a* is interposed between the spring 7 and the plate portion 4*a*. When the actuator 1 exists at the original position, the sliding direction of the receiving member 7*a* (urging direction of the coil spring 7) is perpendicular to one surface of the plate portion 4*a*. When the rotary shaft 4 rotates in an arbitrary direction within a range of 90° or less, this surface of the plate portion 4*a* is inclined in the sliding direction of the receiving member 7*a*. However, when an external force which is applied to the lever 3 is extinguished, the rotary shaft 4 is returned to the original position by the pressing force of the coil spring 7. This returning operation to the original position is assisted by a disc spring 8 which will be explained hereinafter.

The plunger 5 is slidably supported in the direction (the same direction as the sliding direction of the receiving member 7*a*) perpendicular to the axial direction of the rotary shaft 4 in the casing 10. The propagating member 5*a* is fixed to one end of the plunger 5. The edge surface of the member 5*a* is in contact with the other surface of the plate portion 4*a*. The plunger 5 is urged toward the plate portion 4*a* by the disc spring 8 whose peripheral edge is fitted into the casing 10. When the rotary shaft 4 rotates and the plate portion 4*a* is inclined, the plunger 5 causes a displacement in the direction opposite to the side on which the propagating member 5*a* is attached against the urging force of the spring 8.

A switch holder 9 formed of an insulative material is disposed in the casing 10 of the switching apparatus. Two switches 11 and 12 are enclosed in the switch holder 9. The switch 11 comprises two fixed contacts 11*a*, a movable contact 11*b* and an operating axis 11*c* to which the movable contact 11*b* is fixed. The movable contact 11*b* is urged by a coil spring 13 in the direction such that the movable contact 11*b* comes into contact with the fixed contact 11*a* to thereby short-circuit (turn on) between the two fixed contacts 11*a*.

Similarly, the switch 12 also comprises two fixed contacts 12*a*, a movable contact 12*b* and an operating axis 12*c*. The movable contact 12*b* is also urged by a coil spring 14 in the direction such that the movable contact 12*b* comes into contact with the fixed contact 12*a*. The operating axis 12*c* of the switch 12 is shorter than the operating shaft 11*c* of the switch 11.

A switch operating member 6 is supported to the casing 10 and switch holder 9 so as to be slidable in the moving direction of the plunger 5. The operating member 6 has a portion which is pressed by the plunger 5 and the portions adapted to press the operating axes 11*c* and 12*c* of the switches 11 and 12. The operating member 6 is, on the other hand, urged by a coil spring 15 toward the plunger 5 and abuts on a stopper member formed in the casing 10.

When the lever 3 is swung by the contact of an object with the roller 2 and the rotary shaft 4 rotates, the plunger 5 causes a displacement in the direction where the switches 11 and 12 are attached as mentioned above. The operating axes 11*c* and 12*c* of the switches 11 and 12 are pressed through the switch operating member 6 by the displacement of the plunger 5 against the pressing forces of the coil springs 13 and 14, respectively. Therefore, the switches 11 and 12 are switched from the on states to the off states.

Since the operating axis 11*c* of the switch 11 is longer than the operating axis 12*c* of the switch 12, the switch 11 is first switched from the on state to the off state. When the displacement of the actuator 1 further occurs, the switch 12 is switched from the on state to the off state. When the actuator 1 is returned to the original position, the switch 12 is first set from the off state to the on state and thereafter, the switch 11 is set from the off state to the on state.

A signal processor 18 assembled on a printed circuit board is provided in the casing 10. In response to the on/off states of the switches 11 and 12, a switch output and a failure prediction output are produced in the signal processor 18 and transmitted to the outside via a cable 19. An operating power source is supplied to the signal processor 18 via the cable 19.

The casing 10 of the switching apparatus further has indicator lamps 69 and 79 which are turned on by the switch output and failure prediction output, which will be explained hereinafter. The operating state, i.e., the normal or abnormal state of the switching apparatus can be confirmed by the indicator lamps 69 and 79.

Figures 3, 8:
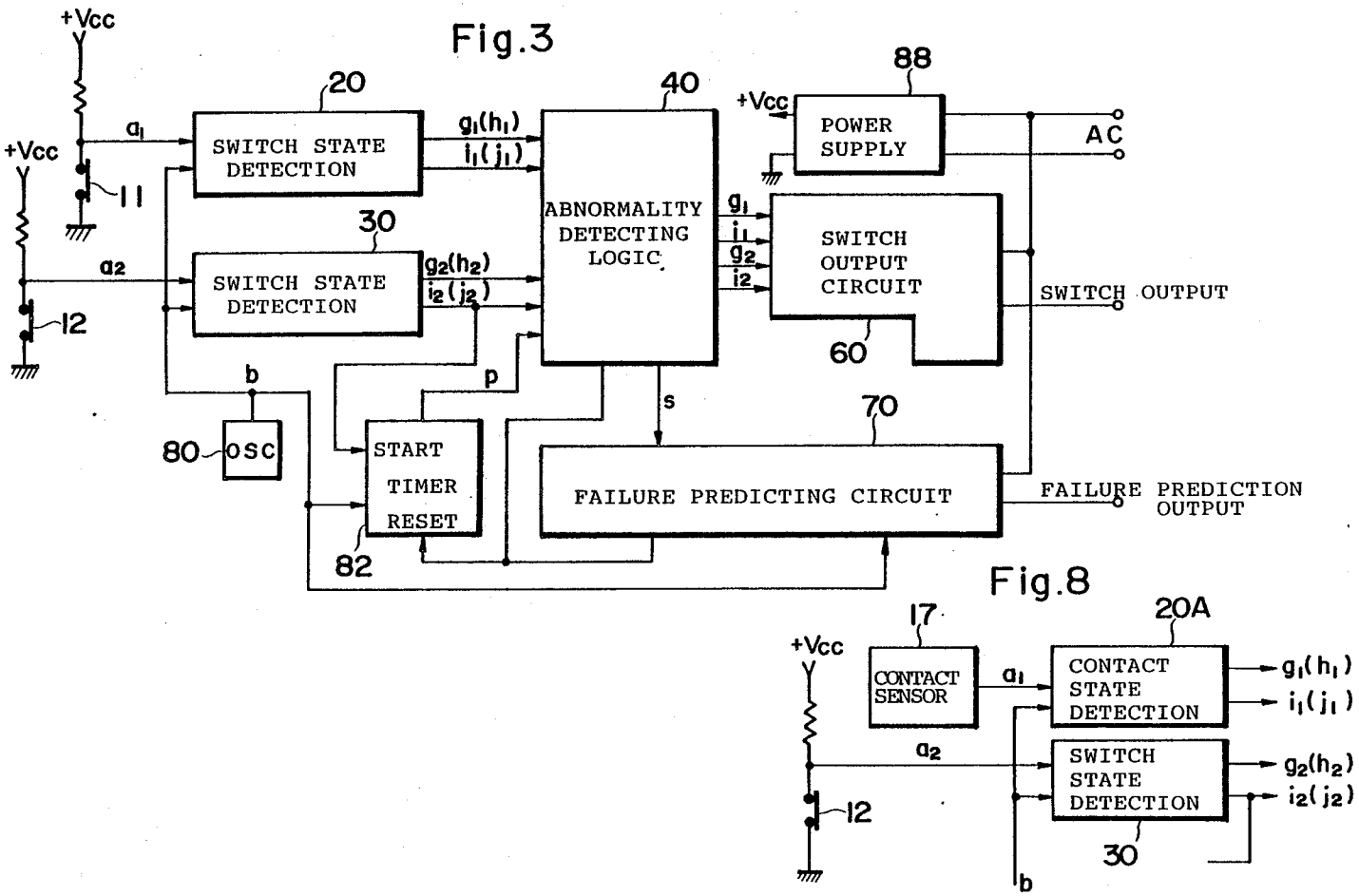
Figure 4A:
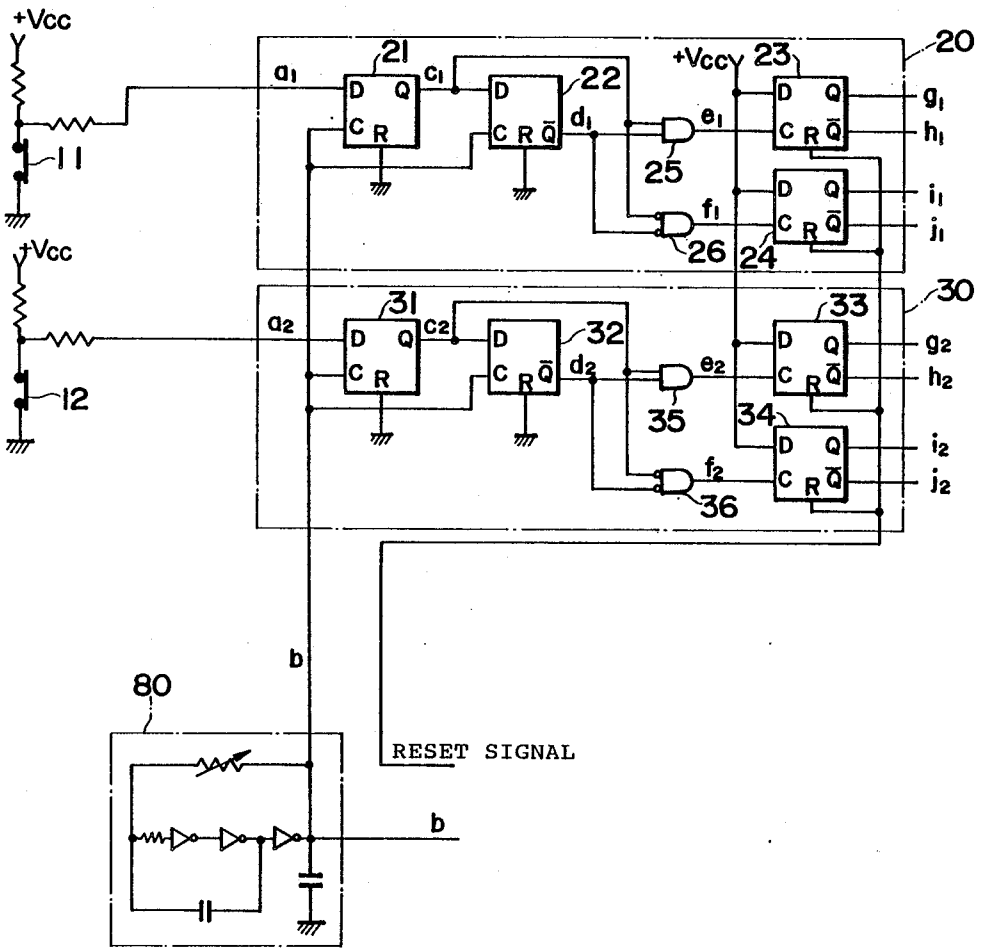
FIGS. 4*a* and 4*b* are circuit diagrams showing the details of the signal processor.
Figure 4B:
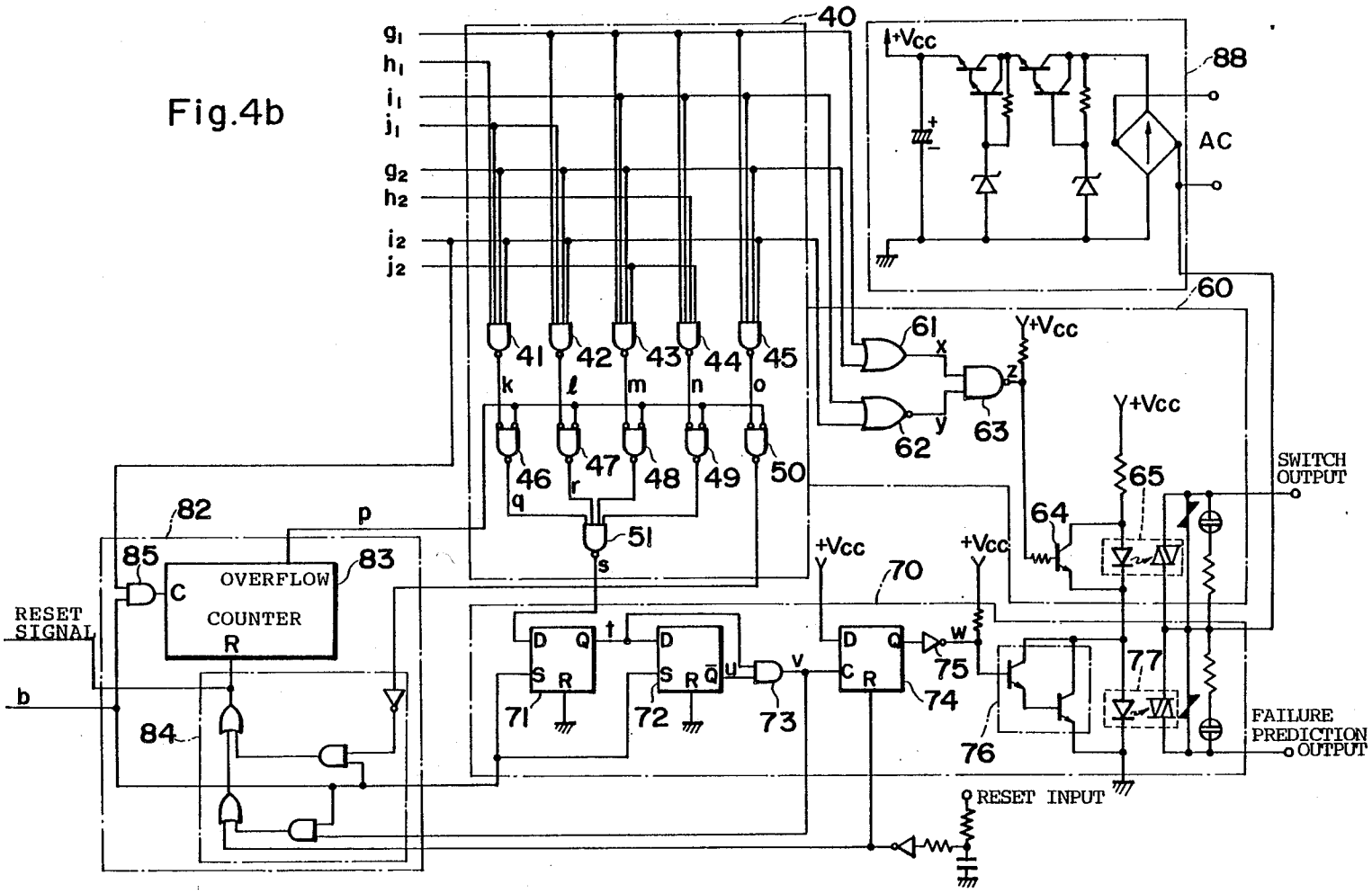
Figure 5A:
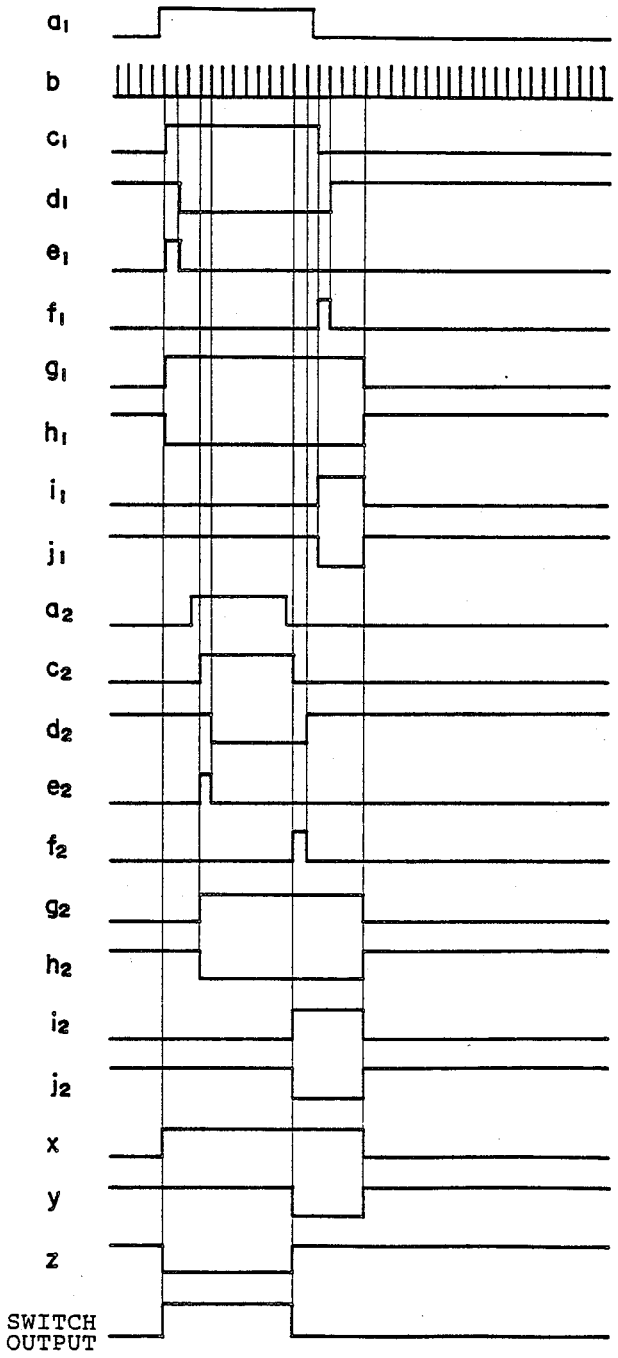
FIGS. 5*a* and 5*b* are time charts showing the normal operation of the switching apparatus.
Figure 5B:
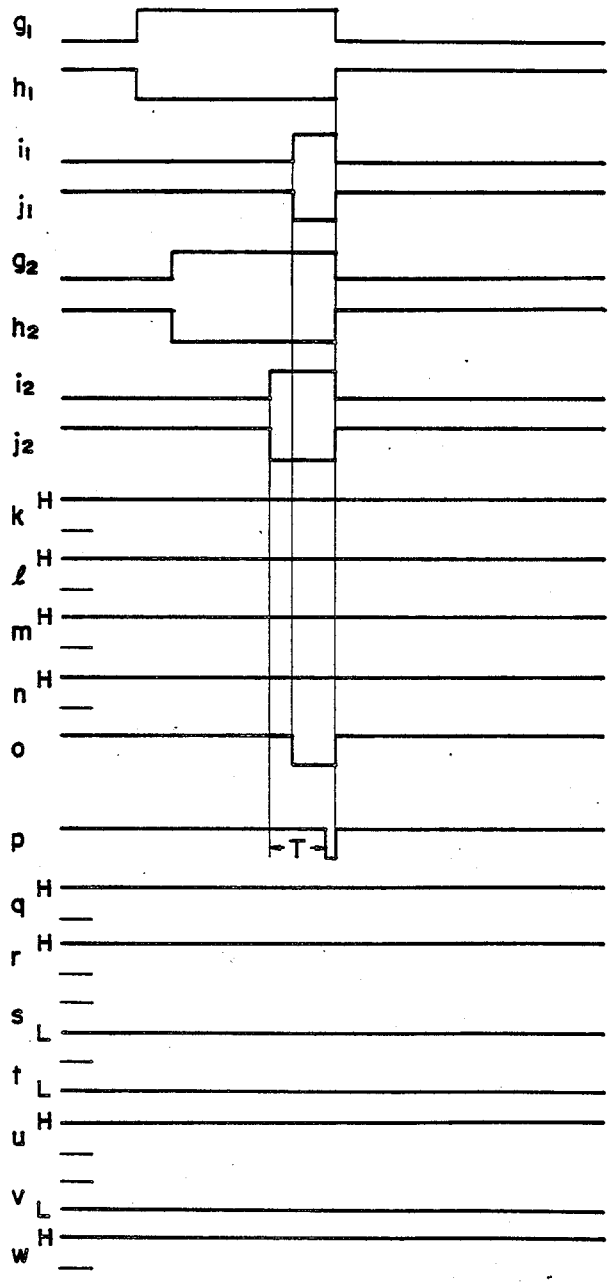
Figure 6A:
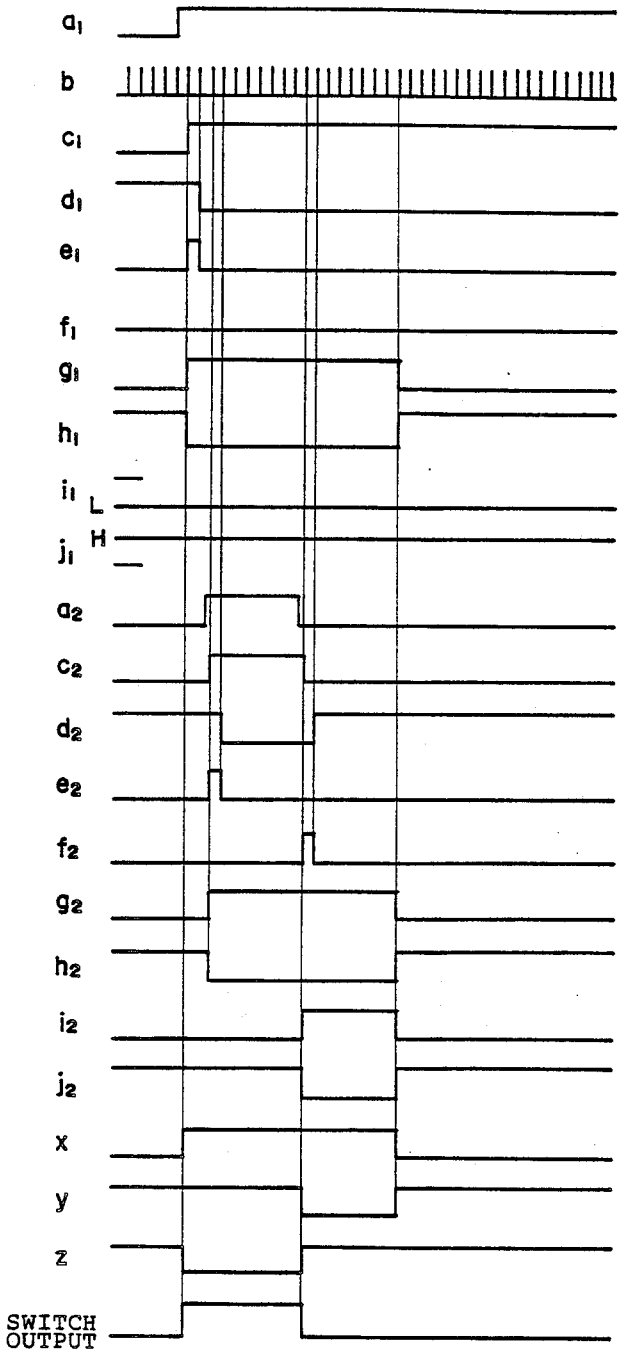
FIGS. 6*a* and 6*b*, and 7*a* and 7*b* are time charts showing the abnormal operation of the switching apparatus, respectively.
Figure 6B:
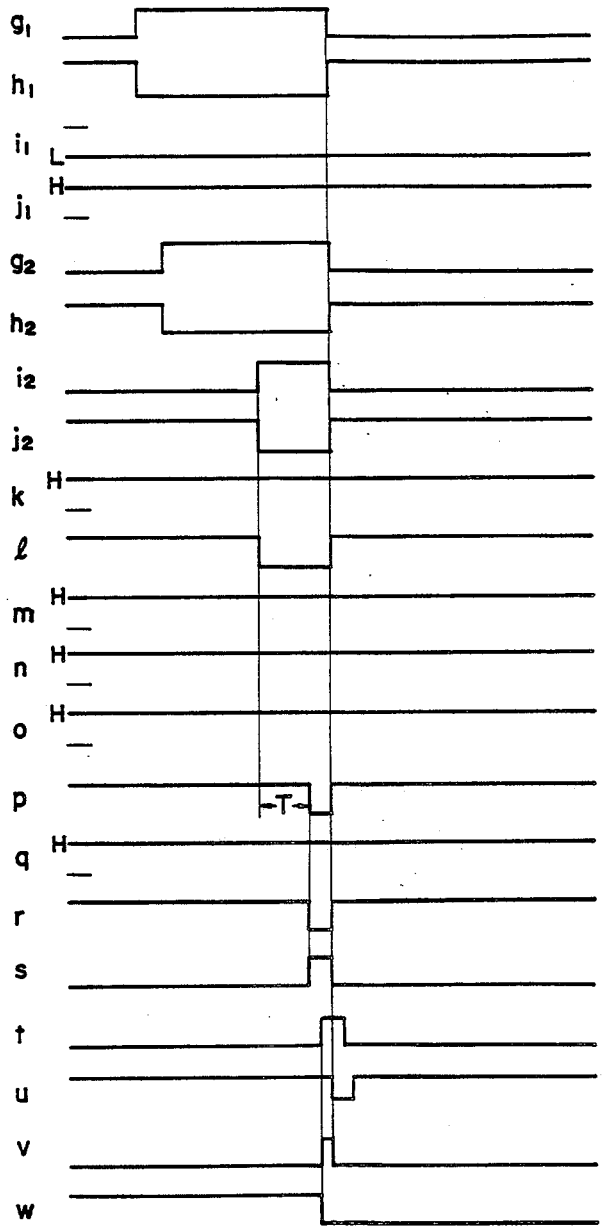
Figure 7A:
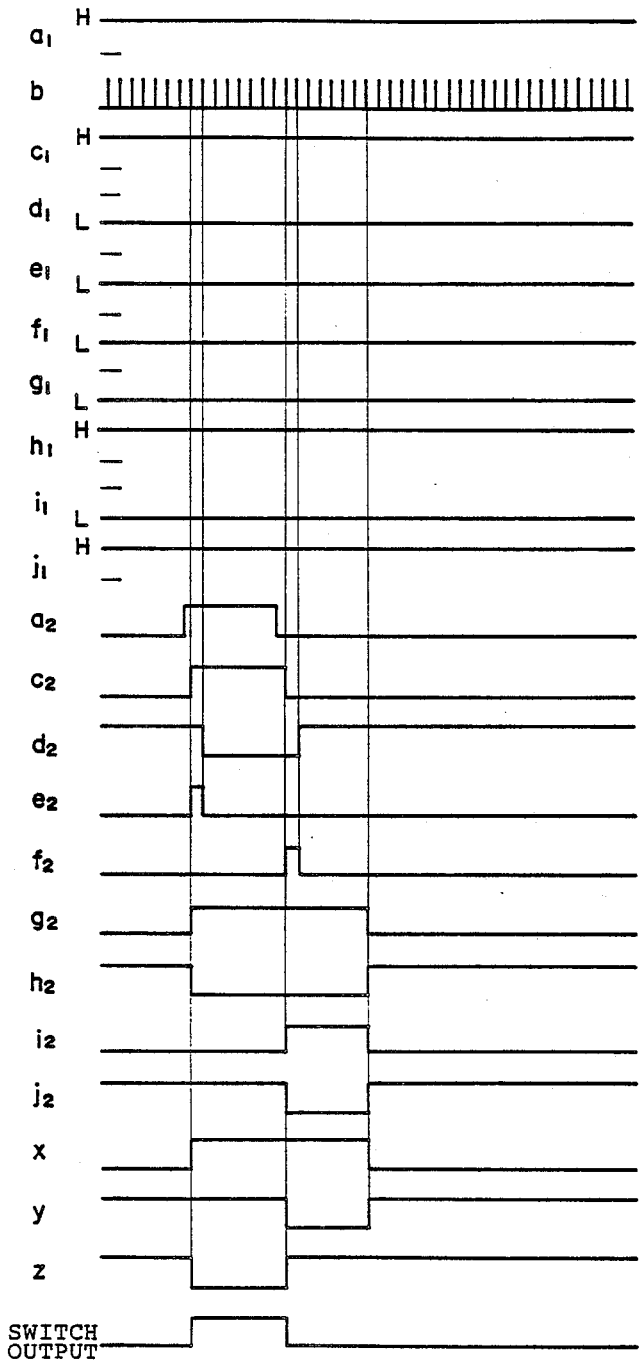
Figure 7B:
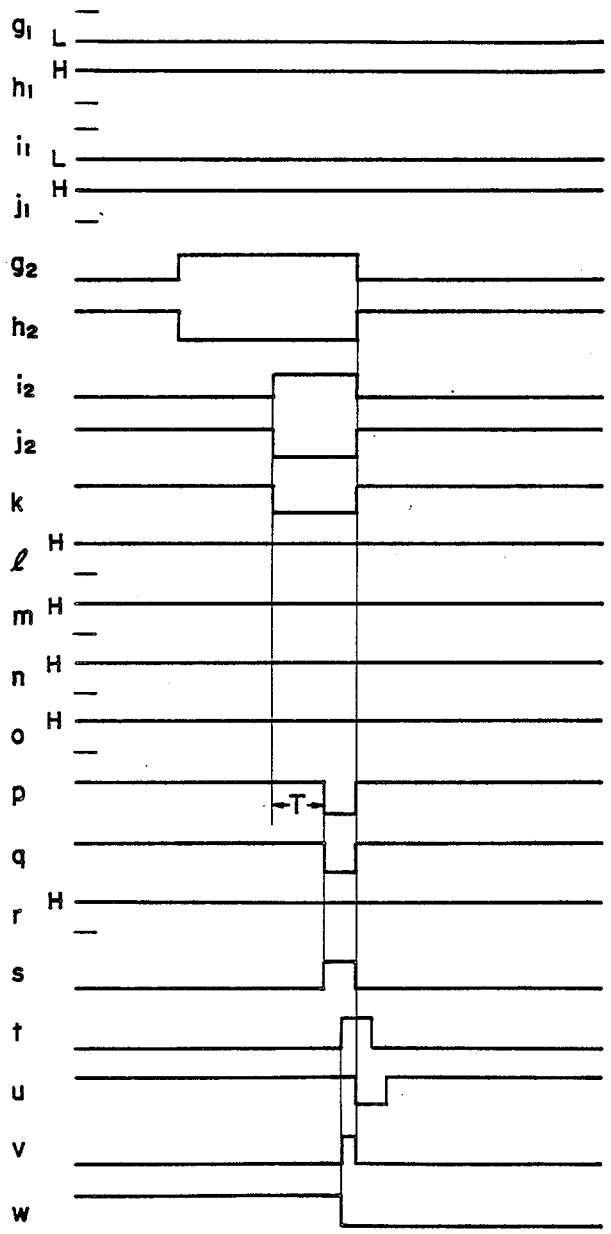

FIG. 3 shows a block diagram showing a construction of the signal processor 18. FIGS. 4*a* and 4*b* show further practical circuit constructions of the signal processor 18. FIGS. 5*a* and 5*b* show timing charts for the normal operation of the signal processor 18.

The signal processor 18 will be first described with respect to the normal operation as an example with reference to those diagrams.

An output clock signal b of a clock oscillator 80 is supplied to switch state detecting circuits 20 and 30, a failure predicting circuit 70 and a timer 82 and is used to synchronize the operations of these circuits. A commercially available AC power source is applied to a power supply circuit 88, by which a proper DC operating voltage $V_{cc}$ is produced and applied to all of the circuits.

On/off signals $a_1$ and $a_2$ of the switches 11 and 12 are input to the switch state detecting circuits 20 and 30, respectively. The signals $a_1$ and $a_2$ are set to the L (low) level when the switches 11 and 12 are in the on state.

The signals $a_1$ and $a_2$ are set to the H (high) level when the switches 11 and 12 are turned off.

The switch state detecting circuit 20 outputs a leading signal $g_1$ (and its inverted signal $h_1$) in response to the switching from the on state to the off state of the switch 11. The detecting circuit 20 outputs a trailing signal $i_1$ (and its inverted signal $j_1$) in response to the switching from the off state to the on state of the switch 11.

Output clock pulses b of the clock oscillator 80 are fed to clock input terminals C of DT flip-flops 21 and 22 of the state detecting circuit 20. The flip-flops 21 and 22, an AND gate 25 and an NAND gate 26 are provided to detect the leading and trailing edges of the on/off signal $a_1$ and constitute a kind of differentiating circuit. When the on/off signal $a_1$ is set to the H level, the flip-flop 21 is set synchronously with the clock pulse b and its Q output $c_1$ is set to the H level. The flip-flop 22 is set at the timing of the next clock pulse b and its $\overline{Q}$ output $d_1$ is inverted to the L level. Therefore, a leading detection pulse $e_1$ indicative of the leading edge of the signal $a_1$ is output from the AND gate 25 and given to the clock input terminal C of a DT flip-flop 23 at the output stage. A trailing detection pulse $f_1$ indicative of the trailing edge of the signal $a_1$ is output from the NAND gate 26 and is similarly given to the clock input terminal C of a DT flip-flop 24 at the output stage. A voltage at the H level is always applied to data input terminals D of the flip-flops 23 and 24. Therefore, the signal $g_1$ which rises synchronously with the pulse $e_1$ and the signal $h_1$ which trails synchronously with the pulse $e_1$ are output from the flip-flop 23. The signal $i_1$ which rises synchronously with the pulse $f_1$ and the signal $j_1$ which trails synchronously with the pulse $f_1$ are output from the flip-flop 24.

The state detecting circuit 30 also operates substantially in the same manner as the detecting circuit 20. Namely, the circuit 30 outputs a leading signal $g_2$ (and its inverted signal $h_2$) in response to the switching from the on state to the off state of the switch 12 and outputs a trailing signal $i_2$ (and its inverted signal $j_2$) in response to the switching from the off state to the on state of the switch 12.

Flip-flops 23, 24, 33 and 34 at the output stage of the circuits 20 and 30 are forcedly reset by a reset signal, which will be explained hereinafter, which is given from an abnormality detecting logic circuit 40 or failure predicting circuit 70.

The timer 82 is made operative in response to the trailing signal $i_2$ of the state detecting circuit 30. Namely, the timer 82 includes a counter 83. When the output signal $i_i$ of the flip-flop 34 of the detecting circuit 30 is at the H level, the output clock pulses b are given from the clock pulse oscillator 80 to a count input terminal C of the counter 83 through an AND gate 85. When the pulses b are input to the counter 83, the counter 83 starts to count these pulses. When its count value becomes a predetermined value (time T), the counter 83 generates an overflow output p (L level). The output signal p is fed to the logic circuit 40. The counter 83 is also reset by the reset signal which is input through a logic circuit 84 and stops its operation.

A switch output circuit 60 generates a final switch output of the switching apparatus. When the leading signal $g_1$ is output from the state detecting circuit 20 (the signal $g_1$ is set to the H level), the switch output to drive various kinds of machines and apparatuses mentioned above is generated in response to the leading signal $g_1$ (in FIG. 5*a*, the switch output is shown as the H level signal). However, when the leading signal $g_1$ is not output but the leading signal $g_2$ is output from the state detecting circuit 30, the switch output is generated in response to the leading signal $g_2$. When the trailing signal $i_2$ is output from the state detecting circuit 30 (the signal $i_2$ is set to the H level), the switch output is stopped in response to the trailing signal $i_2$. However when the trailing signal $i_2$ is not output but the trailing signal $i_1$ is output from the state detecting circuit 20, the switch output is stopped (is set to the L level) in response to the trailing signal $i_1$.

The leading signal $g_1$ of the state detecting circuit 20 and the leading signal $g_2$ of the state detecting circuit 30 are input to an OR gate 61, so that a signal x is produced. The trailing signal $i_1$ of the circuit 20 and the trailing signal $i_2$ of the circuit 30 are input to an NOR gate 62, so that a signal y is produced. The signals x and y are input to an NAND gate 63, so that a signal z is output from the gate 63. When the signal z is set to the L level, a transistor 64 is turned off, so that a photocoupler 65 is turned on.

The abnormality detecting logic circuit 40 outputs an abnormality detection signal s (H level) when it detects the drop-out of at least one of the four signals consisting of the leading signal $g_1$ and trailing signal $i_1$ of the state detecting circuit 20 and the leading signal $g_2$ and trailing signal $i_2$ of the state detecting circuit 30. The logic circuit 40 includes five NAND gates 41 to 45 which receive a proper combination of all of the output signals $g_1$, $h_1$, $i_1$, $j_1$, $g_2$, $h_2$, $i_2$ and $j_2$ of the state detecting circuits 20 and 30. Outputs k, l, m, n and o of the NAND gates 41 to 45 are given to NAND gates 46 to 50 at one input terminal, respectively. The overflow output p of the counter 83 is given to the other input terminals of the NAND gates 46 to 50. Outputs of the NAND gates 46 to 49 (only outputs of the gates 46 and 47 are indicated at q and r, respectively) are transmitted through an NAND gate 51, so that the abnormality detection signal s is derived.

The NAND gate 45 detects the normal operations of the switches 11 and 12. The leading signals $g_1$ and $g_2$ and the trailing signals $i_1$ and $i_2$ are supplied as the input signals to the NAND gate 45. In the normal operation, the output o of the NAND gate 45 is set to the L level. Since the L-level output o and the overflow output p are input to the NAND gate 50, a reset signal at the L level is output from the NAND gate 50. This reset signal is inverted by the logic circuit 84 and given to the flip-flops 23, 24, 33 and 34 and counter 83.

In the normal operation, since all of the outputs k, l, m and n of the NAND gates 41 to 44 are at the H level, the outputs of the NAND gates 46 to 49 are also set to the H level. Finally, the output s of the NAND gate 51 is held at the L level. At this time, the failure predicting circuit 70 does not operate and its failure prediction output is not generated.

The abnormal operation in the case where the failure predicting circuit 70 operates will not be described.

The failure predicting circuit 70 also has a differentiating circuit of the signal s which is constituted by two DT flip-flops 71 and 72 and an AND gate 73. When the output signal s of the logic circuit 40 rises and an output signal v (H level) is generated from the differentiating circuit, a DT flip-flop 74 is set. A Q output (H level) of the flip-flop 74 is inverted into a signal w (L level) by an NOT circuit 75. A transistor switching circuit 76 at the next stage is turned off by the L-level signal w. Thus, a photocoupler 77 is turned on and a failure prediction output is generated. The differentiation signal v is supplied to the logic circuit 84 and is also used to reset the counter 83 and flip-flops 23, 24, 33 and 34. When an abnormality occurs, a reset signal is not output from the NAND gate 50 (the signal o is held at the H level). On the other hand, when a reset signal is input after an abnormality occurs, the DT flip-flop 74 (as well as the other flip-flops 23, 24, 33 and 34 and counter 83) is also reset.

FIGS. *6a* and *6b* show the operation of the signal processor 18 in the case where the actuator 1 was improperly returned. When a detective return of the actuator 1 occurred, for example, after the switch 11 was switched from the on state to the off state, even if the pressing force by the contact with the object is released, the actuator 1 is not returned to the original position. Therefore, the switch 11 is not set to the on state and the output $a_1$ is held at the H level. Therefore, the trailing detection signal $f_1$ is not produced in the state detecting circuit 20. Thus, the output 1 of the NAND gate 42 of the abnormality detecting logic circuit 40 is set from the H level to the L level and the abnormality detection signal s is output at the timing of the overflow signal p. In response to the detection signal s, a failure prediction output is generated from the failure predicting circuit 70 due to this as explained above. Even if such an abnormality occurs, the normal switch output is derived from the switch output circuit 60 by the trailing signal $i_2$ of the state detecting circuit 30.

FIGS. *7a* and *7b* show the operation in the case where a defective contact occurs in the switch 11. In this case, the switch 11 is held in the off state irrespective of the motion of the actuator 1 and is never set to the on state. Neither the leading detection signal $e_1$ and trailing detection signal $f_1$ is producted in the state detecting circuit 20. Since the output k of the NAND gate 41 in the logic circuit 40 is set from the H level to the L level, the abnormality detection output s is generated. Since the other switch 12 normally operates, the normal switch output is generated on the basis of the output signals $g_2$ and $i_2$ of the state detecting circuit 30.

In the foregoing embodiment, the swing motion of the lever 3 by the contact with the object is converted into the rectilinear motion of the plunger 5 and the switches 11 and 12 are operated by the rectilinear motion. However, it is also possible to use an actuator which rectilinearly moves by the contact with an object. In this case, a mechanism to convert the moving direction is unnecessary.

The switches 11 and 12 of the contact type have been used in the embodiment. But, switches of the contactless type may be also used. For example, it is also possible to use photoelectric switches arranged in a manner such that a part of the switch operation member 6 crosses the optical path of the photoelectric switch.

Further, the switches 11 and 12 having the normally closed contacts have been used in the embodiment. However, the invention can be also applied to switches having normally open contacts.

The switching apparatus in the foregoing embodiment comprises: an actuator which causes a displacement by a contact with an object; a first switch which is switched to the on state or off state in response to the displacement of the actuator; a second switch which is switched to the on state or off state later than the first switch in response to the displacement of the actuator; state detecting circuits to detect the on and off states of the first and second switches; a switch output circuit to generate a switch output on the basis of the on state of at least either one of the switches and the off state of least either one of the switches in response to output signals of the state detecting circuits; and a failure predicting circuit to detect an abnormality of either one of the switches on the basis of the outputs of the state detecting circuits and to output a failure prediction signal.

When the actuator causes a displacement by the contact with an object which is conveyed in the production line or the like, the first and second switches are switched in accordance with this order from the on state to the off state or from the off state to the on state. When the object has passed, the force applied to the actuator is extinguished and the actuator is returned to the original position. Thus, the second and first switches are switched from the off state to the on state or from the on state to the off state in accordance with this order.

The switching between the on and off states of the first and second switches is detected by the state detecting circuits. A switch output is produced on the basis of the output signals of the state detecting circuits and at the same time, the occurrence of an abnormality is checked.

Therefore, even if the detective return of the actuator due to an increase in frictional force, insertion of chips or the like, the defective sealing due to the penetration of the water or the like, the defective contact due to the melt-bonding, bending or damage of contacts, insertion of chips, or the like occurred, if the switching between the on state and the off state is normally performed in either one of the first and second switches, various kinds of machines and apparatuses can be activated and stopped. On the other hand, while the operation of the production line is continued, the defective operation of either one of the first and second switches can be detected and it is possible to predict the occurrence of a failure such that the production line will be certainly suddenly stopped. By predicting the occurrence of a failure, a proper countermeasure can be performed. For example, the switching apparatus is repaired at night when the production line is stopped or the like. The sudden stop of the production line can be prevented and the producing efficiency can be improved.

FIG. 8 shows an example of modification of the embodiment. In place of the switch 11, a contact sensor 17 is provided. The contact sensor 17 detects that a transported object has come into contact with a part (e.g., the roller 2) of the actuator 1. When the object comes into contact with it, the output signal $a_1$ of the sensor 17 is set to the H level. When the object is removed, the output signal $a_1$ is set to the L level. A contact state detecting circuit 20A to detect the leading and trailing edges of the signal $a_1$ is constructed in the same manner as the switch state detecting circuit 20. The signal processor 18 is also constructed in the same manner as that shown in FIG. 3 or FIGS. *4a* and *4b*.

The contact sensor 17 can be realized in a manner such that, for example, in a circuit which is grounded through an object when the object touches the actuator 1, a sensor to detect the potential when the circuit is grounded or a current flowing to the ground is provided for this circuit. In this case, each of the roller 2, lever 3 and rotary shaft 4 is formed of a conductive material and an object to be conveyed also has a conductivity.

As another example of the contact sensor, a load cell (load detector) or a strain gauge fixed to the roller 2, lever 3 or rotary shaft 4 can be mentioned.

When the mechanical constitution shown in FIGS. 1 and 2 is applied to this modification, the switch 11 is omitted and only the switch 12 is operated by the switch operating member 6.

In the normal operation as shown in FIGS. 5*a* and 5*b*, the conveyed object touches the actuator 1 and the signal $a_1$ rises. Then, a displacement of the actuator 1 occurs, the switch 12 is turned off, and the signal $a_2$ is set to the H level. Thereafter, when the object moves in the direction so as to be away from the actuator 1, the force which is applied to the actuator 1 by the object is released. The switch 12 is turned on and the signal $a_2$ is set to the low level. When the object is removed from the actuator 1, the output signal $a_1$ of the contact sensor 17 trails.

When some abnormality occurs, it will be easily understood that the normal switch output is generated and the failure prediction output is obtained as shown in FIGS. 6*a*, 6*b*, 7*a* and 7*b*. Namely, the switch output is generated when at least either the detection of the contact by the contact sensor 17 or the switching between the on state and the off state of the switch 12 and at least either the detection of the removal by the contact sensor 17 or the switching to the opposite state between the off state and the on state of the switch 12 are merely performed. On the other hand, a failure prediction output is generated if at least either one of the contact sensor 17 and the switch 12 does not normally operate.

In brief, the switching apparatus in this modification comprises: an actuator which causes a displacement by the contact with an object; a switch which is switched to the on state or off state in association with the displacement of the actuator; contact detecting means for detecting that the object touches the actuator or a member which is interlocked therewith; state detecting circuits to detect the on state and off state of the switch and the contact state and removal state of the object with or from the contact detecting means; a switch output circuit to generate a switch output on the basis of at least either one of the detection of the on state or off state of the switch and the detection of the contact by the contact detecting means and at least either one of the detection of the off state or on state of the switch and the detection of the removal by the contact detecting means in response to an output of the state detecting circuit; and a failure predicting circuit to detect an abnormality of either one of the switch and the contact detecting means on the basis of outputs of the state detecting circuits and to output a failure prediction signal.

Figure 10:
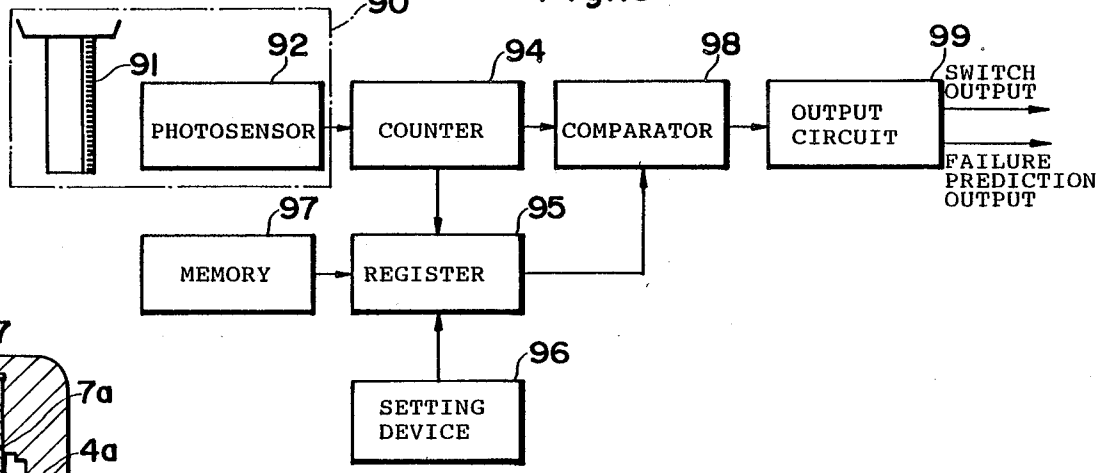
FIGS. 9 and 10 show another embodiment of the present invention.
Figure 9:
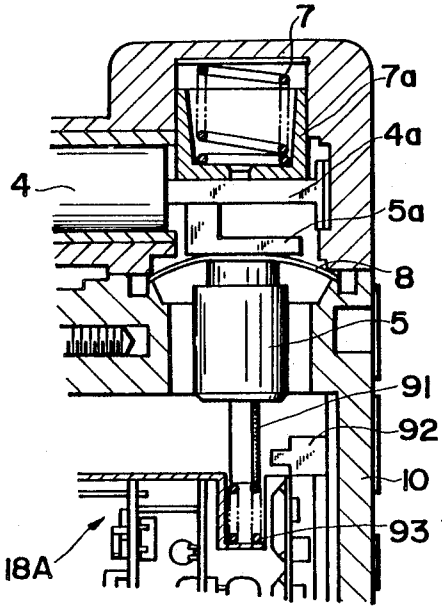

FIGS. 9 and 10 show another embodiment. In FIG. 9, the same parts and components as those shown in FIG. 1 are designated by the same reference numerals and their descriptions are omitted.

In FIG. 9, a scale plate 91 extending in the displacement direction of the plunger 5 is fixed to the lower end surface of the plunger 5 on the side opposite to the propagating member 5*a*. A scale position of the scale plate 91 is detected by a photosensor 92. The photosensor 92 is fixed to the casing 10. Either the reflecting type photosensor or the transmitting type photosensor may be used as the photosensor 92. A displacement sensor or linear encoder 90 (refer to FIG. 10) is constituted by the scale plate 91 and photosensor 92. Forward or reverse pulses as many as the pulses proportional to the displacement amount of the plunger 5, i.e., scale plate 91 and indicative of the displacement direction are generated from the displacement sensor 90. A coil spring 93 is attached to return the plunger 5 to the original position through the scale plate 91.

FIG. 10 shows a practical example of a signal processor 18A provided in the casing 10.

The output pulses of the displacement sensor 90 are input to a counter 94. When the scale plate 91 moves in association with the swing of the actuator 1, output pulses are generated from the displacement sensor 90. The counter 94 adds these output pulses (forward pulses) when an object touches the actuator 1. The counter 94 subtracts those output pulses (reverse pulses) when the actuator is returned to the original position by the removal of the object. A value (first set value) smaller than the maximum count value of the number of pulses which are output from the sensor 90 in the normal state is set into a setting device 96. In the normal state, when the actuator 1 is completely returned to the original position, the final value of the counter 94 is set to zero. The value of 0 or a value near 0 (this value is referred to as a second set value) is stored in a memory 97.

The first and second set values set in the setting device 96 and memory 97 are transmitted to a register 95, respectively. These values are compared with the count value of the counter 94 by a comparator 98. When the count value of the counter 94 is equal to or larger than the first set value, the comparator 98 supplies a first comparison output to an output circuit 99. In response to this output, the output circuit 99 generates a switch output. Namely, when a certain operation displacement amount less than the normal displacement amount is detected, the switch output is generated. Thereafter, when the actuator 1 is returned to the original position, if the final value of the counter 94 is larger than the second set value, the comparator 98 supplies a second comparison output to the output circuit 99. In response to this output, the output circuit 99 generates a failure prediction signal. Namely, when the final value of the counter 94 is not 0 or a value near it, a failure prediction signal is generated.

The counter 94, register 95, setting device 96, comparator 98 and output circuit 99 constitute switching means. The counter 94, register 95, memory 97, comparator 98 and output circuit 99 constitute failure predicting means.

In the foregoing construction, when the actuator 1 causes a displacement by the contact of a conveyed object with the roller 2, the number of pulses which are output from the displacement sensor 90 is counted by the counter 94. When the count value of the counter 94 becomes equal to or larger than the first set value corresponding to the operation displacement amount set in the setting device 96, a switch output is generated from the output circuit 99, so that various kinds of machines or apparatuses are made operative. Thereafter, when the actuator 1 is returned to the original position due to the removal of the object and the count value of the counter 94 is subtracted and becomes smaller than the value corresponding to the operation displacement amount, the switch output from the output circuit 99 is stopped and the driving of the various kinds of machines and apparatuses is stopped.

When the final value of the count value of the counter 94 does not become 0 as the normal displacement amount or a value within an allowable range near 0, this means that the frictional force for the displacement of the actuator 1 increased and the defective return of the actuator 1 occurred. Therefore, a failure prediction signal is generated from the output circuit 99. On the other hand, when the final value of the count value of the counter 94 exceeds 0 as the normal displacement amount or a value within an allowable range near 0, it is determined that an overrun occurred. Therefore, a failure prediction signal is similarly generated. In any cases, the occurrence of the defective operation of the actuator 1 is informed. In this manner, it is possible to inform the operator to properly inspect or repair the apparatus at night or the like when the production line is stopped.

In place of the foregoing up/down counter 94, it is also possible to use a counter for adding input pulses until the actuator 1 reaches the return displacement from the displacement after the start of the displacement. A preset counter which subtracts the count value from a reference value can be also used. In this case, the set values in the setting device 96 and memory 97 are changed in accordance with the kind of counter.

It is also possible to use displacement sensors with various kinds of constructions such as a displacement sensor comprising a magnetic scale in which magnetic materials are arranged at regular intervals and a magnetic sensor, such as a displacement sensor is used to detect a displacement amount based on a change in resistance value in association with a displacement of the scale plate, and the like.

The switching apparatus in this embodiment comprises: an actuator which causes a displacement by the contact with an object; a displacement sensor to detect a displacement amount of the actuator; switching means for generating a switch output when a predetermined operation displacement amount less than a normal displacement amount which is detected by the displacement sensor in the normal state is detected; and failure predicting means for comparing a final displacement amount detected by the displacement sensor with a predetermined final normal displacement amount and for outputting a failure prediction signal when the difference between the final displacement amount and the final normal displacement amount is a predetermined value or more.

According to this constitution, when the actuator receives a pressing force by the contact with an object which is conveyed in the production line or the like and causes a displacement, a displacement amount of the actuator is detected by the displacement sensor. When the detected displacement amount has reached an operation displacement amount which had been preset to a value smaller than the displacement amount in the normal state, a switch output is generated. Thus, various kinds of machines or apparatuses are made operative or stopped. On the other hand, when a defective return, overreturn (i.e., overrun) or the like of the actuator occurs, the final displacement amount indicative of the final position of the actuator has a value different from that of the final normal displacement amount. When the difference between the final displacement amount and the final normal displacement amount is above a predetermined value, a failure prediction signal is output. Thus, the occurrence of the abnormality by a defective return or the like of the actuator which is caused by the increase in frictional force, insertion of chips or the like is informed, thereby making it possible to inform the operator to repair the switching apparatus.

Therefore, even when the defective return or the like of the actuator occurred, if the actuator causes a displacement of a predetermined operation displacement amount less than the displacement amount in the normal state, a switch output is generated, so that various kinds of machines and apparatuses can be made operative and stopped. In this manner, while the operation of the production line is continued, a failure such that the production line will be certainly suddenly stopped can be predicted.

In the foregoing embodiment, the displacement amount is detected using the displacement sensor such as a photosensor, magnet scale or the like without using a limit switch of the contact type. Therefore, the defective sealing due to the penetration of the water or the like, the defective contact due to the melt-bonding or bending or damage of the contacts, insertion of chips, or the like does not occur. The occurrence of an abnormality itself can be suppressed. A switching apparatus having the excellent durability can be realized.

On the other hand, the displacement sensor can be miniaturized as compared with a switch consisting of a fixed contact, a movable contact, a return spring of the movable contact and the like. Thus, the space in the casing can be reduced. Assuming that the external dimensions of the casing are constant, a thickness of casing can be made thick and the strength of the casing can be increased.

What is claimed is:

1. A switching apparatus comprising:

an actuator which is displacable by contact with an object to at least first and second displacement positions;

first detecting means for producing a first detection output when said first displacement position of the actuator is detected;

second detecting means for producing a second detection output when said second displacement position of the actuator is detected, said first and second detection outputs being produced in sequence;

means for generating a switch output when at least one of said first and second detection outputs is produced; and abnormality detecting means for detecting an abnormality based on at least one of the first and second detection outputs of said first and second detecting means, said abnormality detecting means comprising a clocking means for providing a clocking signal indicating a time lapse from a time point when one of said first and second detection outputs is produced and a checking means for checking whether the detection states of the first and second detecting means are a predetermined state responsive to said clocking means measuring a predetermined time lapse after said time point when said one of said first and second detection outputs is produced.

2. A switching apparatus according to claim 1, wherein said first detecting means is a first switch which is switched to the on state or the off state in association with the displacement of the actuator, said second detecting means is a second switch which is switched to the on state or the off state later than said first switch in association with the displacement of the actuator;

said means for generating a switch output comprising a switch output circuit for generating the switch output when one of said first and second switches is in the on state and the other of said first and second switches is in the off state, and said abnormality detecting means comprises a failure predicting circuit which detects an abnormality of either of said first and second switches on the basis of the on and off states of said first and second switches and which outputs a failure prediction signal.

3. A switching apparatus according to claim 1, wherein said first detecting means is a switch which is switched to the on state or the off state in association with the displacement of the actuator, said second detecting means is a contact detecting means for detecting that an object is touching the actuator or a member which is interlocked therewith, said means for generating a switch output comprising a switch output circuit for generating the switch output when at least one of the on state or off state of said switch is detected and the contact of the object by said contact detecting means is detected, and at least one of the off state or on state of said switch is detected and removal of the object by said contact detecting means is detected, and said abnormality detecting means comprises a failure predicting circuit which detects an abnormality of either of said switch and said contact detecting means based on the on and off states of said switch and the contact detecting state by said contact detecting means, and which outputs a failure prediction signal.

4. A switching apparatus comprising:

an actuator which is displacable by contact with an object to at least first and second displacement positions;

first detecting means for producing a first detection output when said first displacement position of the actuator is detected;

second detecting means for producing a second detection output when said second displacement position of the actuator is detected;

means for generating a switch output when at least one of said first and second detection outputs is produced; and abnormality detecting means for detecting an abnormality based on at least one of the first and second detection outputs of said first and second detecting means;

wherein said first detecting means and said means for generating a switch output are formed by a displacement sensor which detects a displacement amount of the actuator and switching means for generating the switch output when a predetermined operation displacement amount less than a normal displacement amount which is detected by said displacement sensor in a normal operational state is detected by said displacement sensor, and said second detecting means and said abnormality detecting means are formed by said displacement sensor and a failure predicting means for comparing a final displacement amount detected by said displacement sensor with a predetermined final normal displacement amount and for outputting a failure prediction signal when the difference between the final displacement amount and the final normal displacement amount is above a predetermined value.

5. A switching apparatus comprising:

an actuator which causes a displacement by a contact with an object;

a first switch which is switched to the on state or the off state in association with a displacement of the actuator;

a second switch which is switched to the on state or the off state later than said first switch in association with the displacement of the actuator;

state detecting circuits which detect the on state and the off state of said first and second switches;

a switch output circuit which generates a switch output based on the on state of one of said first and second switches and the off state of the other of said first and second switches in response to output signals of said state detecting circuits; and a failure predicting circuit which detects an abnormality of either of said first and second switches based on the outputs of said state detecting circuits and which outputs a failure prediction signal.

6. A switching apparatus comprising:

an actuator which causes a displacement by a contact with an object;

a switch which is switched to the on state or the off state in association with a displacement of the actuator;

contact detecting means for detecting that the object is touching the actuator or a member which is interlocked therewith;

state detecting circuits which detect the on state and the off state of said switch and the contact state and the removal state of the object with and from said contact detecting means;

a switch output circuit which generates a switch output on the basis of at least one of the detection of the on state or off state of said switch and the contact detection by said contact detecting means, and at least one of the detection of the off state or on state of said switch and the removal detection by said contact detecting means in response to outputs of said state detecting circuits; and a failure predicting circuit which detects an abnormality of either of said switch and said contact detecting means based on the outputs of said state detecting circuits and which outputs a failure prediction signal.

7. A switching apparatus comprising:

an actuator which causes a displacement by a contact with an object;

a displacement sensor which detects a displacement amount of the actuator;

switching means for generating a switch output when a predetermined operation displacement amount less than a normal displacement amount which is detected by said displacement sensor in a normal operational state is detected by said displacement sensor; and failure predicting means for comparing a final displacement amount detected by said displacement sensor with a predetermined final normal displacement amount and for outputting a failure prediction signal when the difference between the final displacement amount and the final normal displacement amount is greater than or equal to a predetermined value.

* * * * *